US010323438B2

(12) United States Patent
Chang et al.

(10) Patent No.: US 10,323,438 B2
(45) Date of Patent: Jun. 18, 2019

(54) TWO-POINT LOCK

(71) Applicant: DOOR & WINDOW HARDWARE CO., Taichung (TW)

(72) Inventors: Wei-Hung Chang, Taichung (TW); Chih-Lun Hsieh, Taichung (TW)

(73) Assignee: DOOR & WINDOW HARDWARE CO., Taichung (TW)

( * ) Notice: Subject to any disclaimer, the term of this patent is extended or adjusted under 35 U.S.C. 154(b) by 295 days.

(21) Appl. No.: 15/366,051

(22) Filed: Dec. 1, 2016

(65) Prior Publication Data

US 2018/0155964 A1 Jun. 7, 2018

(51) Int. Cl.

| | |
|---|---|
| ***E05B 65/08*** | (2006.01) |
| ***E05B 63/18*** | (2006.01) |
| ***E05B 63/06*** | (2006.01) |

(52) U.S. Cl.

CPC ..... *E05B 65/0858* (2013.01); *E05B 63/06* (2013.01); *E05B 63/18* (2013.01); *E05B 65/0811* (2013.01)

(58) Field of Classification Search

CPC ..... Y10T 292/0825–0829; Y10T 292/0848; Y10T 292/0849; Y10T 292/0852; Y10T 292/0853; Y10T 292/0862; Y10T 292/0913; Y10T 292/0914; Y10T 292/0916; Y10T 292/0917; Y10T 292/1043; Y10T 292/1075; Y10T 292/1039; Y10T 292/0803; Y10T 292/0911; Y10T 292/0945; Y10T 292/0946; Y10T 292/0929; Y10T 292/0926; Y10T 70/5173; Y10T 70/5195; Y10S 292/46; Y10S 292/60; E05B 63/042; E05B 63/06; E05B 63/185; E05B 63/18; E05B 65/0811; E05B 65/0858; E05C 9/16

See application file for complete search history.

(56) References Cited

U.S. PATENT DOCUMENTS

| | | | | | |
|---|---|---|---|---|---|
| 2,701,156 | A * | 2/1955 | Palmer, Jr. | E05B 65/0817 | 292/113 |
| 2,736,185 | A * | 2/1956 | Collar | E05B 65/0811 | 292/106 |
| 2,789,852 | A * | 4/1957 | Eads | E05B 65/0817 | 292/110 |
| 3,105,711 | A * | 10/1963 | Woodworth | E05B 65/0817 | 292/113 |
| 5,820,170 | A * | 10/1998 | Clancy | E05B 65/0858 | 292/26 |
| 6,264,252 | B1 * | 7/2001 | Clancy | E05B 65/0858 | 292/123 |

(Continued)

*Primary Examiner* — Alyson M Merlino
(74) *Attorney, Agent, or Firm* — Burris Law, PLLC

(57) ABSTRACT

A two-point lock includes a casing unit, an adjusting unit and a locking unit. The adjusting unit includes two first adjusting guide plates pivoted to casing unit, and two second adjusting guide plates pivoted to the casing unit. The locking unit includes first and second hook members respectively pivotable between the first adjusting guide plates and between the second adjusting guide plates. The first adjusting guide plates are operable to adjust an extent by which the first hook member extends out of the casing unit. The second adjusting guide plates are operable to adjust an extent by which the second hook member extends out of the casing unit.

10 Claims, 13 Drawing Sheets

(56) References Cited

U.S. PATENT DOCUMENTS

| | | | | |
|---|---|---|---|---|
| 7,604,265 | B2 * | 10/2009 | Tsai | E05B 65/0858 292/116 |
| 8,376,414 | B2 * | 2/2013 | Nakanishi | E05B 63/042 292/26 |
| 8,931,812 | B1 * | 1/2015 | Hauber | E05B 65/0858 292/26 |
| 2006/0091679 | A1 * | 5/2006 | Tsai | E05B 65/0858 292/24 |
| 2007/0068205 | A1 * | 3/2007 | Timothy | E05B 65/0858 70/100 |

* cited by examiner

TWO-POINT LOCK

FIELD

The disclosure relates to a locking device, and more particularly to a two-point lock.

BACKGROUND

A conventional multi-point lock disclosed in U.S. Pat. No. 6,264,252 is for use in a sliding door, and includes two hook members, two rotary operating members, two rod members each of which is pivotally connected between a respective one of the hook members and a respective one of the rotary operating members, and an interlink member that pivotally interconnects the rotary operating members. When one of the rotary operating members is rotated to drive rotation of the corresponding one of the hook members via the corresponding one of the rod members, the other one of the hook members is also driven to synchronously rotate via the interlink member, the other one of the rotary operating members and the other one of the rod members. However, such a structure is relatively complex. Moreover, the hook members may easily be rotated non-synchronously after long term use of the conventional multi-point lock.

Referring to FIGS. 1, 2 and 3, a conventional two-point lock disclosed in U.S. Pat. No. 8,376,414 is for use in a sliding door, and includes an outer casing 1, a locking unit 2 movably mounted to the outer casing 1, and an adjusting unit 3 disposed between the outer casing 1 and locking unit 2 and operable to move the locking unit 2 relative to the outer casing 1. The locking unit 2 includes a mounting casing 201 that is movable relative to the outer casing 1 in a first direction, two hook members 202 that are pivotally mounted to the mounting casing 201, an actuating plate 203 (see FIG. 3) that is movable relative to the mounting casing 201 in a second direction transverse to the first direction for driving rotation of the hook members 202, a rotary operating member 204 that is pivotally mounted to the mounting casing 201, a link member 205 (see FIG. 3) that is pivotally connected between the actuating plate 203 and the rotary operating member 204, and a torsion spring 206 (see FIG. 3) that is disposed between the rotary operating member 204 and a rod portion 207 of the mounting casing 201. Each of the hook members 202 has a driven pin portion 208 (see FIG. 3). The actuating plate 203 has two actuating grooves 209 (see FIG. 3) respectively and slidably engaged with the pin portions 208 of the hook members 203.

When the rotary operating member 204 is rotated to move the actuating plate 203 in the second direction via the link member 205, the hook members 202 are driven by the actuating plate 203 to perform locking or unlocking operation. However, with particular reference to FIGS. 1 and 2, to adjust an extent (H) by which the hook members 202 extend out of the outer casing 1, the adjusting unit 3 is operated to move the whole locking unit 2 relative to the outer casing 1. In other words, the conventional two-point lock of U.S. Pat. No. 8,376,414 employs such a structure that includes inner and outer casings (i.e., the mounting casing 201 and the outer casing 1) in order to adjust the extent (H) by which the hook members 202 extend out of the outer casing 1. Such double-casing structure may increase the weight of the whole conventional two-point lock, and increase the manufacturing cost of the conventional two-point lock as well.

Moreover, with particular reference to FIG. 3, the rotary operating member 204 is simply pivotally connected to the link member 205, and a lengthwise extending line of the rotary operating member 204 cooperates with a horizontal line to form a relatively small angle (θ, about 35 degrees) therebetween when the hook members 202 are at an unlocking position. As such, in the beginning of the operation of the rotary operating member 204 to move each of the hook members 202 away from the unlocking position, a user needs to rotate the rotary operating member 204 to generate a resultant force (F) much greater than a horizontal component (Fx) thereof that is required for moving the actuating plate 203. In this case, $F=Fx/\sin\theta=Fx/\sin 35°=1.7Fx$. More specifically, the user needs to rotate the rotary operating member 204 to generate 1.7 times the required force to move the actuating plate 203. Such operation is also laborious. In addition, the torsion spring 206 deforms considerably during the operation of the rotary operating member 204, and may therefore occupy a relatively large space in the outer casing 1.

SUMMARY

Therefore, an object of the disclosure is to provide a two-point lock that employs a single element for driving two hook members adjustable in projecting extent independently of each other, and that has a simplified casing structure.

According to the disclosure, the two-point lock includes an elongated casing unit, an adjusting unit and a locking unit. The casing unit extends in a first direction. The adjusting unit includes a pair of first adjusting guide plates that are pivoted to and disposed in the casing unit and that are spaced apart from each other, a first adjusting assembly that is disposed to the casing unit, a pair of second adjusting guide plates that are pivoted to and disposed in the casing unit and that are spaced apart from each other, and a second adjusting assembly that is disposed to the casing unit. Each of the first adjusting guide plates has a first arc-shaped groove. The first adjusting assembly includes a first adjusting bolt that is rotatably mounted to the casing unit, and a first nut member that is engaged threadably with the first adjusting bolt and that is coupled to the first adjusting guide plates. The first adjusting bolt is rotatable to move the first nut member so as to rotate the first adjusting guide plates relative to the casing unit. The second adjusting guide plates are spaced apart from the first adjusting guide plates in the first direction. Each of the second adjusting guide plates has a second arc-shaped groove. The second adjusting assembly includes a second adjusting bolt that is rotatably mounted to the casing unit, and a second nut member that is engaged threadably with the second adjusting bolt and that is coupled to the second adjusting guide plates. The second adjusting bolt is rotatable to move the second nut member so as to rotate the second adjusting guide plates relative to the casing unit. The locking unit includes a first hook member that is pivotable between the first adjusting guide plates, a second hook member that is pivotable between the second adjusting guide plates, an actuating guide plate that is disposed between the first adjusting guide plates and between the second adjusting guide plates and that is substantially movable in the first direction, a rotary operating member that is rotatably disposed on the casing unit, and a link member that is connected between the actuating guide plate and the rotary operating member. The first hook member has a first driven pin portion that movably engages the first arc-shaped grooves of the first adjusting guide plates, and a first pivoted pin portion that is pivoted to the first adjusting guide plates. The second hook member has a second driven pin portion that movably engages the second arc-shaped grooves of the second adjusting guide plates, and a second pivoted pin portion that is pivoted to the second adjusting guide plates. The actuating guide plate has a first driving groove that is movably engaged with the first driven pin portion of the first hook member, a second driving groove that is movably engaged with the second driven pin portion of the second hook member, a first guiding groove that extends in the first direction and that is movably engaged with the first pivoted pin portion of the first hook member, and a second guiding groove that extends in the first direction and that is movably engaged with the second pivoted pin portion of the second hook member. The rotary operating member is located outside a space between the first and second hook members, and is adjacent to an end of the casing unit in the first direction. The rotary operating member is operable to move the actuating guide plate in the first direction via the link member, so as to move each of the first and second hook members relative to the casing unit between an unlocking position and a locking position. When the first and second hook members are at the unlocking position, the first and second hook members are located within the casing unit. When the first and second hook members are at the locking position, the first and second hook members extend out of the casing unit. When the first and second hook members move between the unlocking position and locking position, the first driven pin portion of the first hook member moves along the first arc-shaped grooves of the first adjusting guide plates, and the second driven pin portion of the second hook member moves along the second arc-shaped grooves of the second adjusting guide plates. The first adjusting guide plates and the first adjusting assembly are operable to adjust an extent by which the first hook member extends out of the casing unit when the first hook member is at the locking position. The second adjusting guide plates and the second adjusting assembly are operable to adjust an extent by which the second hook member extends out of the casing unit when the second hook member is at the locking position.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
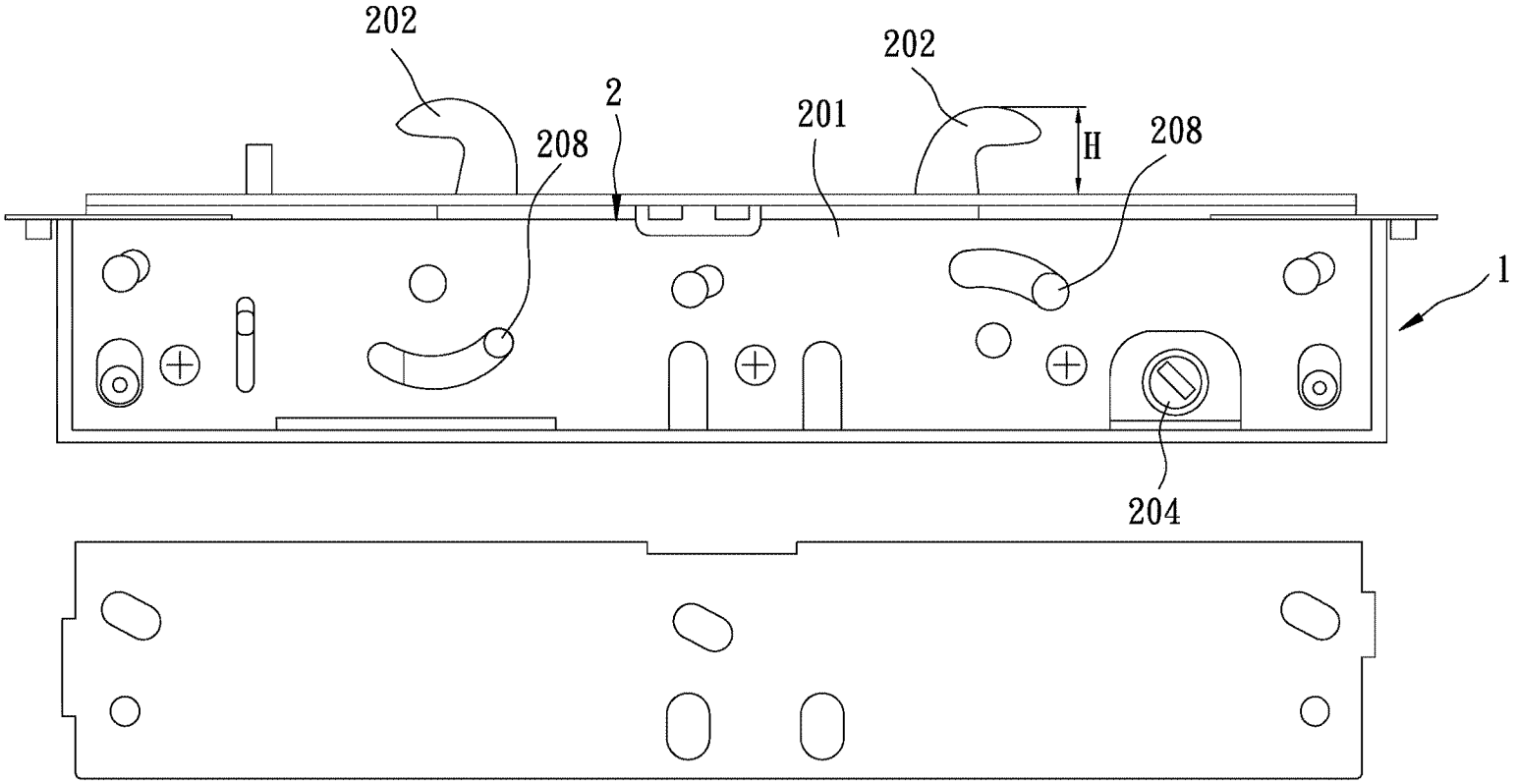
FIG. 1 PRIOR ART
FIG. 1 is a schematic side view illustrating a conventional two-point lock disclosed in U.S. Pat. No. 8,376,414.
Figure 2:
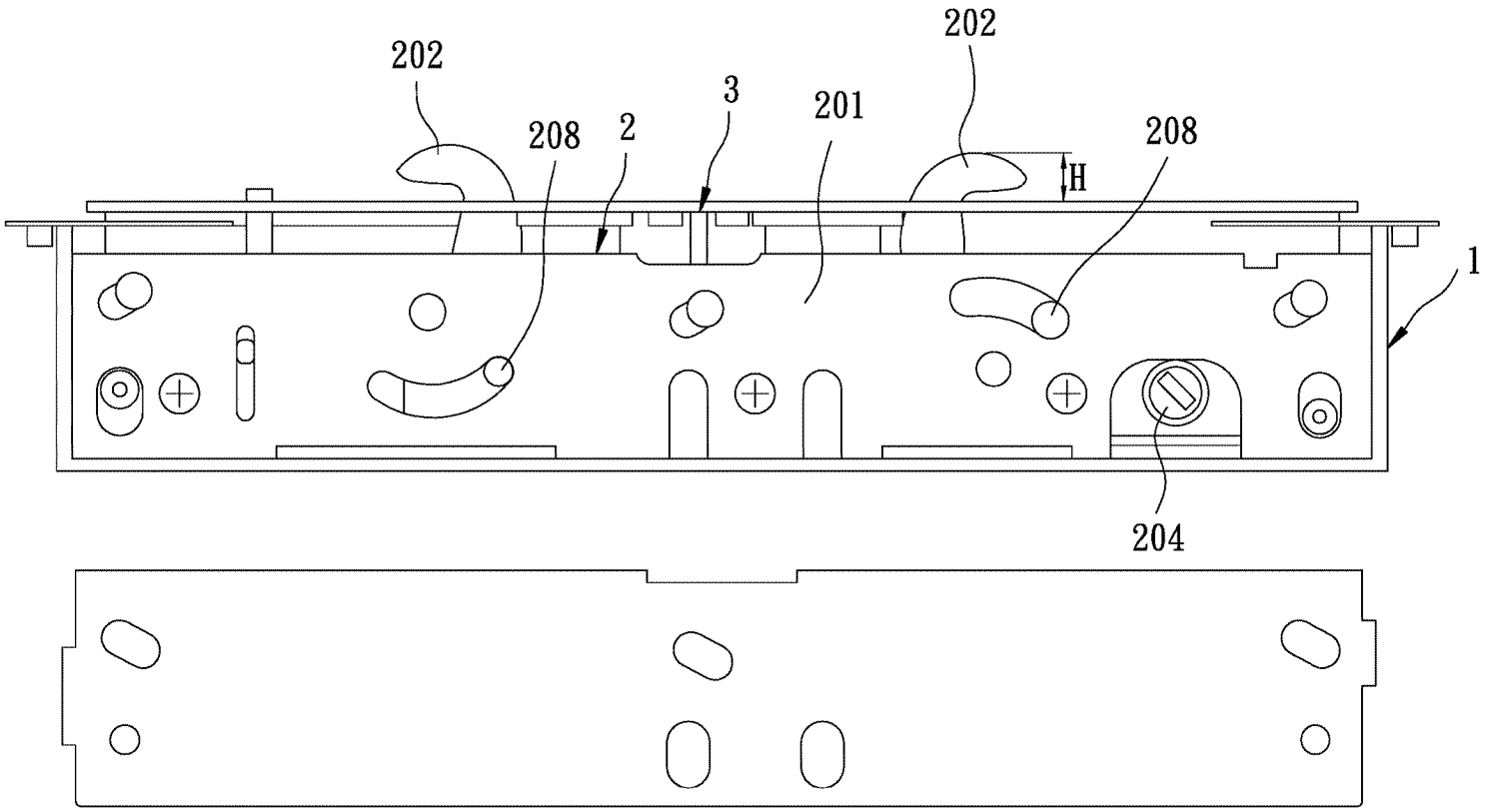
FIG. 2 PRIOR ART
FIG. 2 is another schematic side view illustrating the conventional two-point look.
Figure 3:
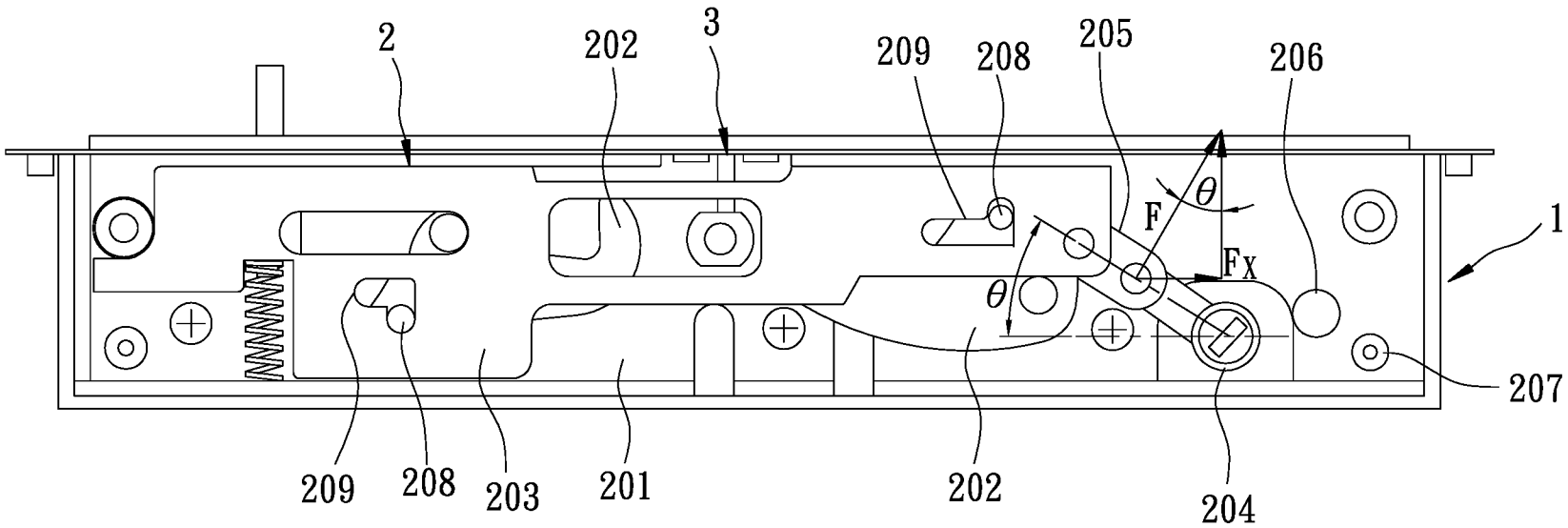
FIG. 3 is still another schematic side view illustrating the conventional two-point look.
Figure 4:
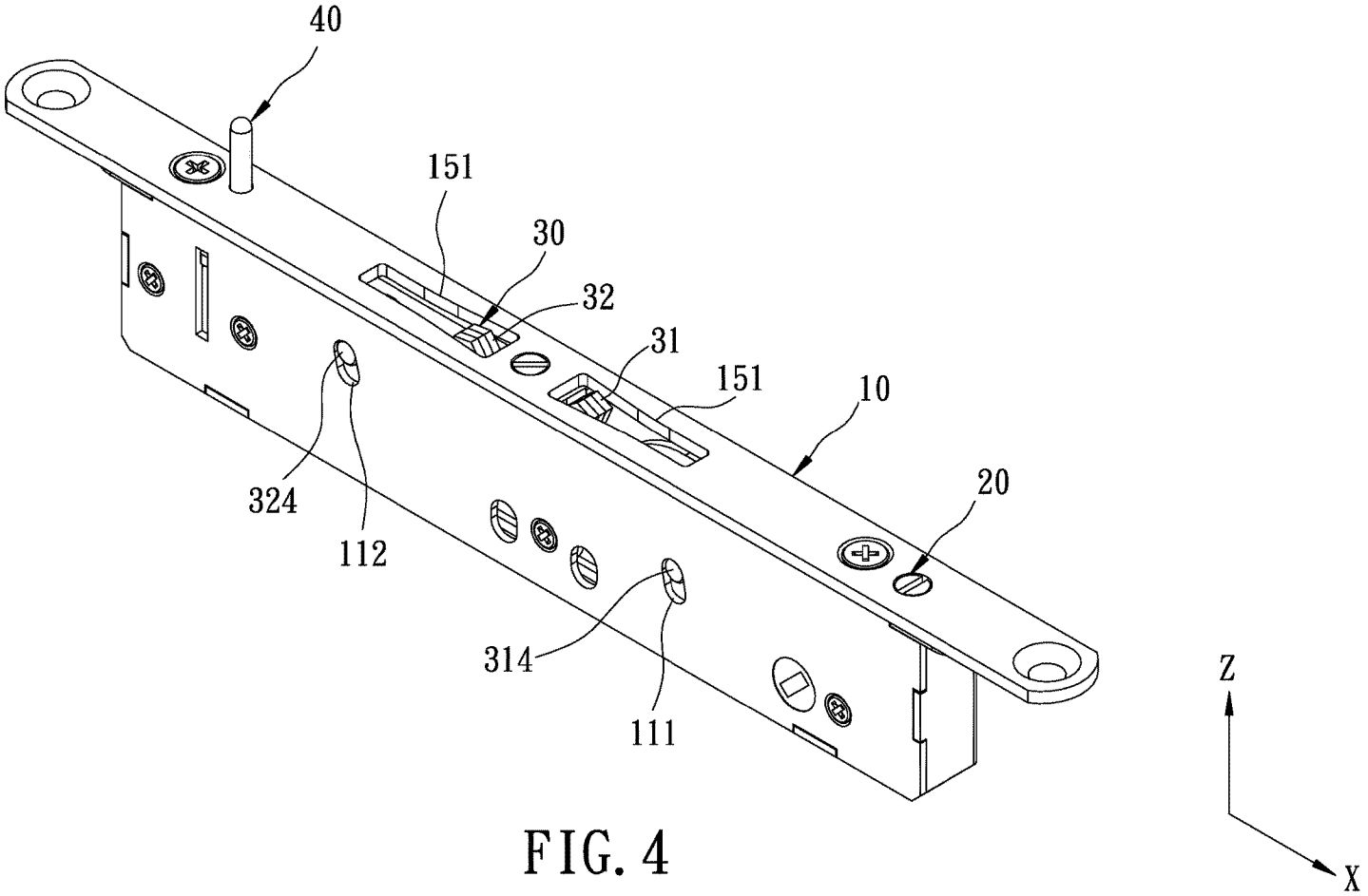
FIG. 4 is a perspective view illustrating an embodiment of the two-point lock according to the disclosure.
Figure 5:
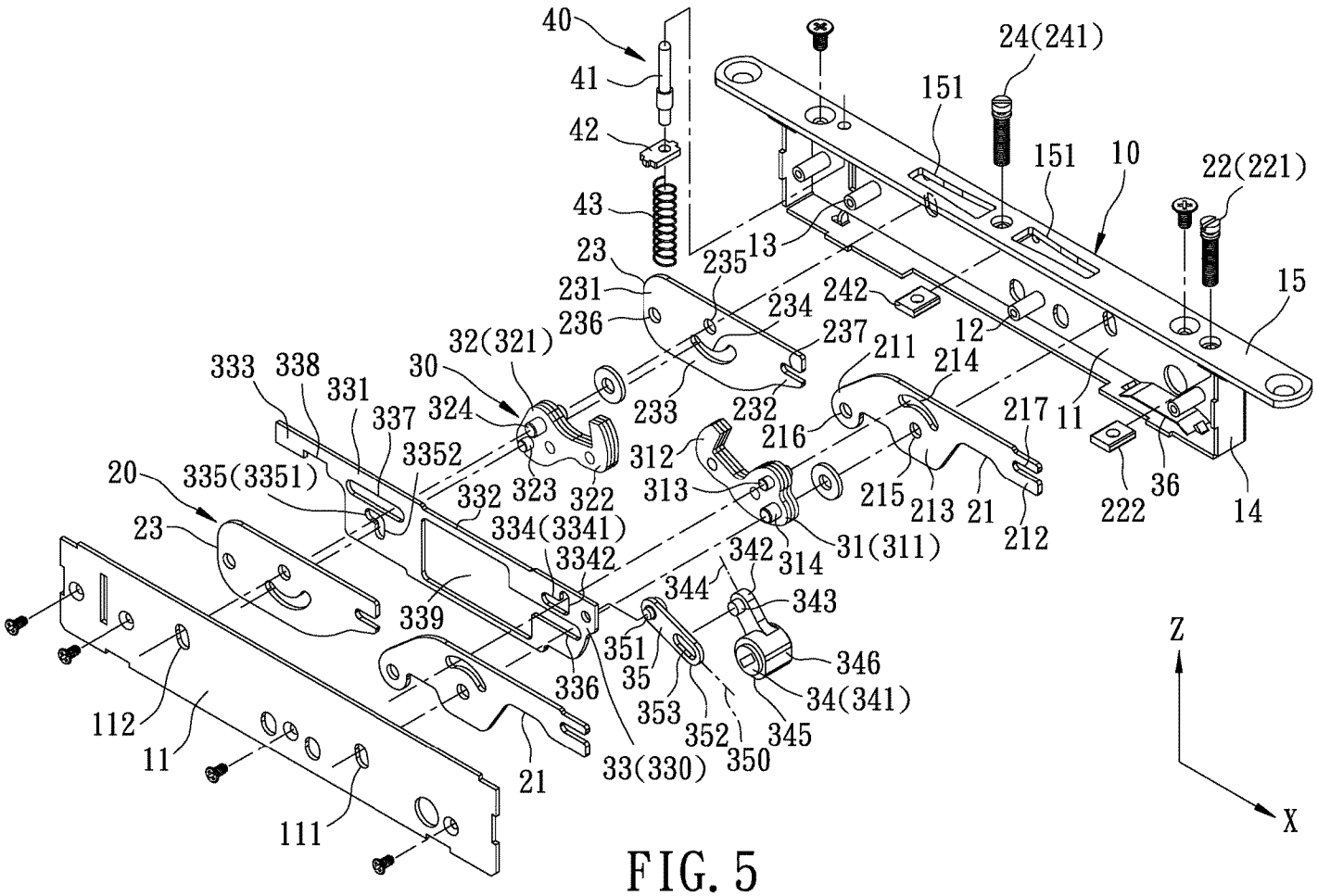
FIG. 5 is an exploded perspective view illustrating the embodiment.

Referring to FIGS. 4 and 5, the embodiment of the two-point lock according to the disclosure includes an elongated casing unit 10, an adjusting unit 20, a locking unit 30 and a safety unit 40.

The casing unit 10 extends in a first direction (X), and includes two side walls 11 that are spaced apart from each other, a first axle portion 12 that is disposed between the side walls 11, a second axle portion 13 that is disposed between the side walls 11 and that is spaced apart from the first axle portion 12, a surrounding wall 14 that is integrally connected to one of the side walls 11, and an end wall 15 that is integrally connected to the one of the side walls 11 and the surrounding wall 14. It should be noted that, in the drawings of this disclosure, the first direction (X) is illustrated as a horizontal direction. However, in general use, the two-point lock is mounted to a sliding door (not shown), and the first direction (X) extends vertically.

In this embodiment, each of the side walls 11 has a first height limiting groove 111, and a second height limiting groove 112 that is spaced apart from the first height limiting groove 111. Each of the first and second axle portions 12, 13 integrally extends from the one of the side walls 11 and connected to the other one of the side walls 11. The end wall 15 has two through grooves 151.

Figure 6:
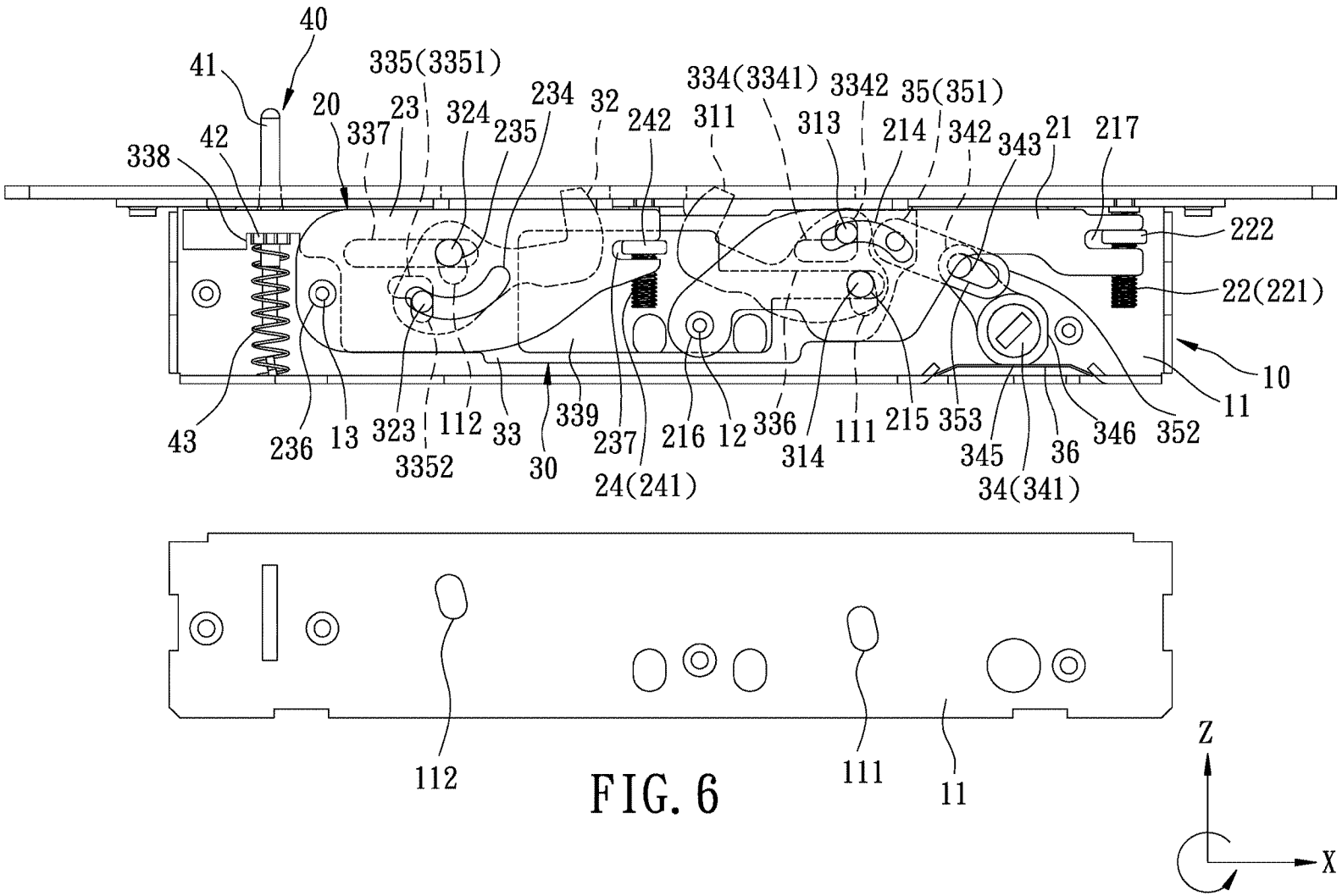
FIG. 6 is a schematic side view illustrating first and second hook members of the embodiment, each of which is at an unlocking position.
Figure 7:
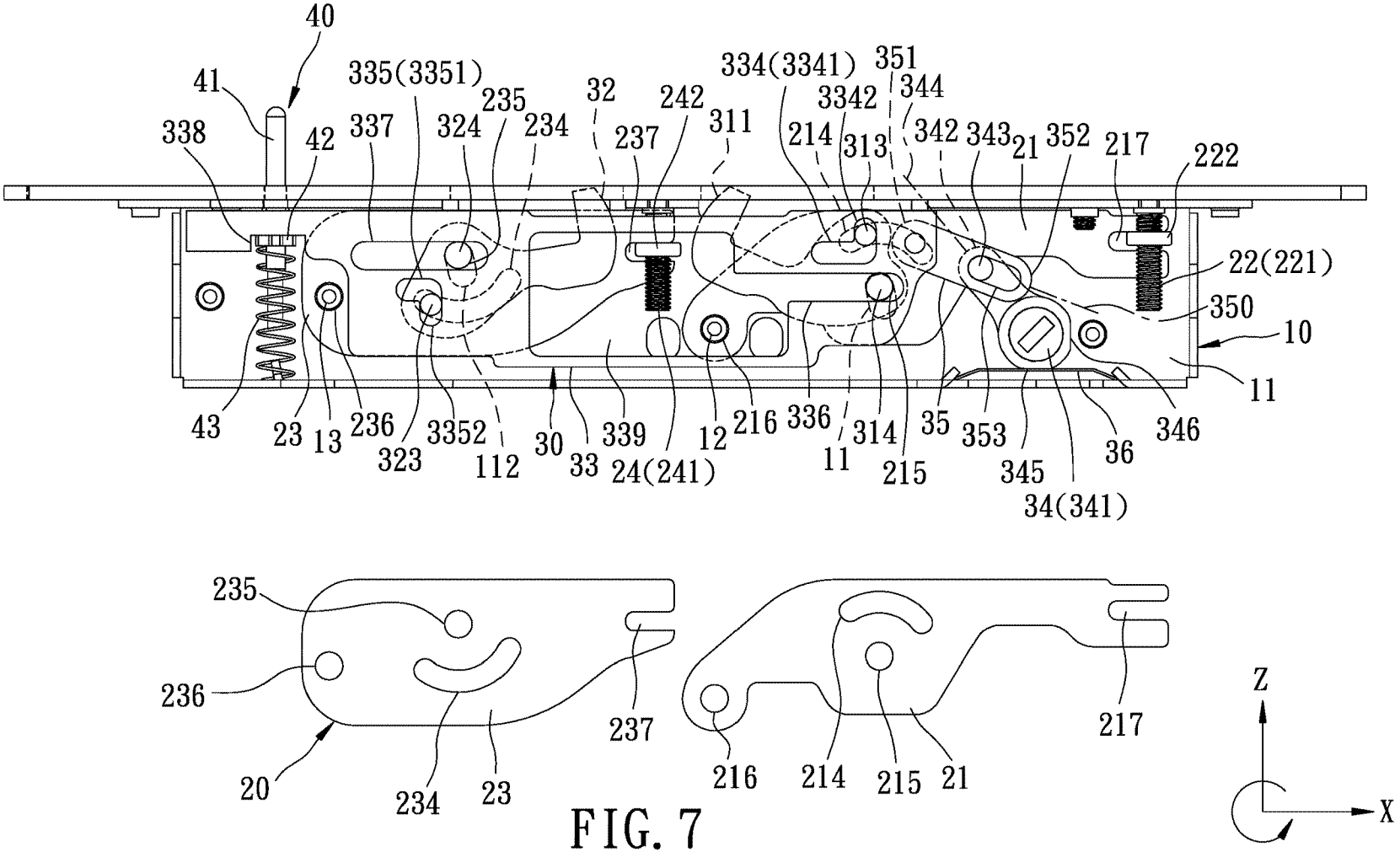
FIG. 7 is another schematic side view illustrating the first and second hook members, each of which is at an unlocking position.

Referring to FIGS. 5, 6 and 7, the adjusting unit 20 includes a pair of first adjusting guide plates 21 that are pivoted to and disposed in the casing unit 10 and that are spaced apart from each other, a first adjusting assembly 22 that is disposed to the casing unit 10, a pair of second adjusting guide plates 23 that are pivoted to and disposed in the casing unit 10 and that are spaced apart from each other, and a second adjusting assembly 24 that is disposed to the casing unit 10.

The first adjusting assembly 22 includes a first adjusting bolt 221 that is rotatably mounted to the end wall 15 of the casing unit 10, and a first nut member 222 that is engaged threadably with the first adjusting bolt 221.

In this embodiment, each of the first adjusting guide plates 21 has a first pivoted end portion 211 that is pivoted to the casing unit 10, a first adjusting end portion 212 that is coupled to the first nut member 222 of the first adjusting assembly 22, a first intermediate portion 213 that is connected between the first pivoted end portion 211 and the first adjusting end portion 212, a first arc-shaped groove 214 that is formed in the first intermediate portion 213, a first pivot hole 215 that is formed in the first intermediate portion 213, a first axle hole 216 that is formed in the first pivoted end portion 211, and a first engaging groove 217 that is formed in the first adjusting end portion 212. For each of the first adjusting guide plates 21, the first pivot hole 215 is located at the center of curvature of the first arc-shaped groove 214. The first axle hole 216 of each of the first adjusting guide plates 21 permits the first axle portion 12 of the casing unit 10 to rotatably extend therethrough, so that the first adjusting guide plates 21 are pivotable about the first axle portion 12 of the casing unit 10.

In this embodiment, the first nut member 222 of the first adjusting assembly 22 movably engages the first engaging groove 217 of each of the first adjusting guide plates 21. The first adjusting bolt 221 is rotatable to drive the first nut member 222 to move in a second direction (Z) that is perpendicular to the first direction (X), so as to rotate the first adjusting guide plates 21 relative to the casing unit 10.

The second adjusting assembly 24 includes a second adjusting bolt 241 that is rotatably mounted to the end wall 15 of the casing unit 10, and a second nut member 242 that is engaged threadably with the second adjusting bolt 241.

The second adjusting guide plates 23 are spaced apart from the first adjusting guide plate 21 in the first direction (X). In this embodiment, each of the second adjusting guide plates 23 has a second pivoted end portion 231 that is pivoted to the casing unit 10, a second adjusting end portion 232 that is coupled to the second nut member 242 of the second adjusting assembly 24, a second intermediate portion 233 that is connected between the second pivoted end portion 231 and the second adjusting end portion 232, a second arc-shaped groove 234 that is formed in the second intermediate portion 233, a second pivot hole 235 that is formed in the second intermediate portion 233, a second axle hole 236 that is formed in the second pivoted end portion 231, and a second engaging groove 237 that is formed in the second adjusting end portion 232. For each of the second adjusting guide plates 23, the second pivot hole 235 is located at the center of curvature of the second arc-shaped groove 234. The second axle hole 236 of each of the second adjusting guide plates 23 permits the second axle portion 13 of the casing unit 10 to rotatably extend therethrough, so that the second adjusting guide plates 23 are pivotable about the second axle portion 13 of the casing unit 10.

In this embodiment, the second nut member 242 of the second adjusting assembly 24 movably engages the second engaging groove 237 of each of the second adjusting guide plates 23. The second adjusting bolt 241 is rotatable to drive the second nut member 242 to move in the second direction (Z), so as to rotate the second adjusting guide plates 23 relative to the casing unit 10.

The locking unit 30 includes a first hook member 31 that is pivotable between the first adjusting guide plates 21, a second hook member 32 that is pivotable between the second adjusting guide plates 23, an actuating guide plate 33 that is disposed between the first adjusting guide plates 21 and between the second adjusting guide plates 23 and that is substantially movable in the first direction (X), a rotary operating member 34 that is rotatably disposed on the casing unit 10, a link member 35 that is connected between the actuating guide plate 33 and the rotary operating member 34, and a positioning resilient plate 36 that is disposed between the rotary operating member 34 and the casing unit 10.

In this embodiment, the first hook member 31 has a base portion 311, a hook portion 312 that extends from the base portion 311, a first driven pin portion 313 that is disposed at the base portion 311 and that slidably engages the first arc-shaped grooves 214 of the first adjusting guide plates 21, and a first pivoted pin portion 314 that is disposed at the base portion 311, that rotatably engages the first pivot holes 215 of the first adjusting guide plates 21, and that slidably engages the first height limiting grooves 111 of the side walls 11 of the casing unit 10.

In this embodiment, the second hook member 32 has a base portion 321, a hook portion 322 that extends from the base portion 321, a second driven pin portion 323 that is disposed at the base portion 321 and that slidably engages the second arc-shaped grooves 234 of the second adjusting guide plates 23, and a second pivoted pin portion 324 that is disposed at the base portion 321, that rotatably engages the second pivot holes 235 of the second adjusting guide plates 23, and that slidably engages the second height limiting grooves 112 of the side walls 11 of the casing unit 10.

In this embodiment, the actuating guide plate 33 has a first plate portion 330 that corresponds in position to the first hook member 31, a second plate portion 331 that corresponds in position to the second hook member 32, an intermediate portion 332 that is connected between the first and second plate portions 330, 331, an extension portion 333 that extends from the second plate portion 331 away from the first plate portion 330 in the first direction (X), a first driving groove 334 that is formed in the first plate portion 330 and that is slidably engaged with the first driven pin portion 313 of the first hook member 31, a second driving groove 335 that is formed in the second plate portion 331 and that is slidably engaged with the second driven pin portion 323 of the second hook member 32, a first guiding groove 336 that extends in the first direction (X) and that is slidably engaged with the first pivoted pin portion 314 of the first hook member 31, a second guiding groove 337 that extends in the first direction (X) and that is slidably engaged with the second pivoted pin portion 324 of the second hook member 32, a safety limiting groove 338 that is formed in the extension portion 333, and a through groove 339 that is formed in the intermediate portion 332 and that permits the second nut member 242 to extend therethrough for preventing the actuating guide plate 33 from interfering with some components.

The first driving groove 334 has a first groove portion 3341 that extends in the first direction (X), and a second groove portion 3342 that is substantially perpendicular to the first groove portion 3341. The second driving groove 335 has a first groove portion 3351 that extends in the first direction (X), and a second groove portion 3352 that is substantially perpendicular to the first groove portion 3351. The first guiding groove 336 is formed in the first plate portion 330. The second guiding groove 337 is formed in the second plate portion 331.

In this embodiment, the link member 35 has an imaginary reference line 350, a first end portion 351 that is pivotally connected to the first plate portion 330 of the actuating guide plate 33, a second end portion 352 that is opposite to the first end portion 351, and an elongated groove 353 that extends along the imaginary reference line 350 and that is proximate to the second end portion 352.

The rotary operating member 34 is located outside a space between the first and second hook members 31, 32, and is adjacent to an end of the casing unit 10 in the first direction (X). In this embodiment, the rotary operating member 34 has an input end portion 341 that is pivoted to the side walls 11 of the casing unit 10, an output end portion 342 that is opposite to the input end portion 341, a guiding pin portion 343 that is disposed at the output end portion 342 and that slidably engages the elongated groove 353 of the link member 35, and an imaginary reference line 344 extending along the output end portion 342. The input end portion 341 is formed with first and second positioning surfaces 345, 346.

Figure 8:
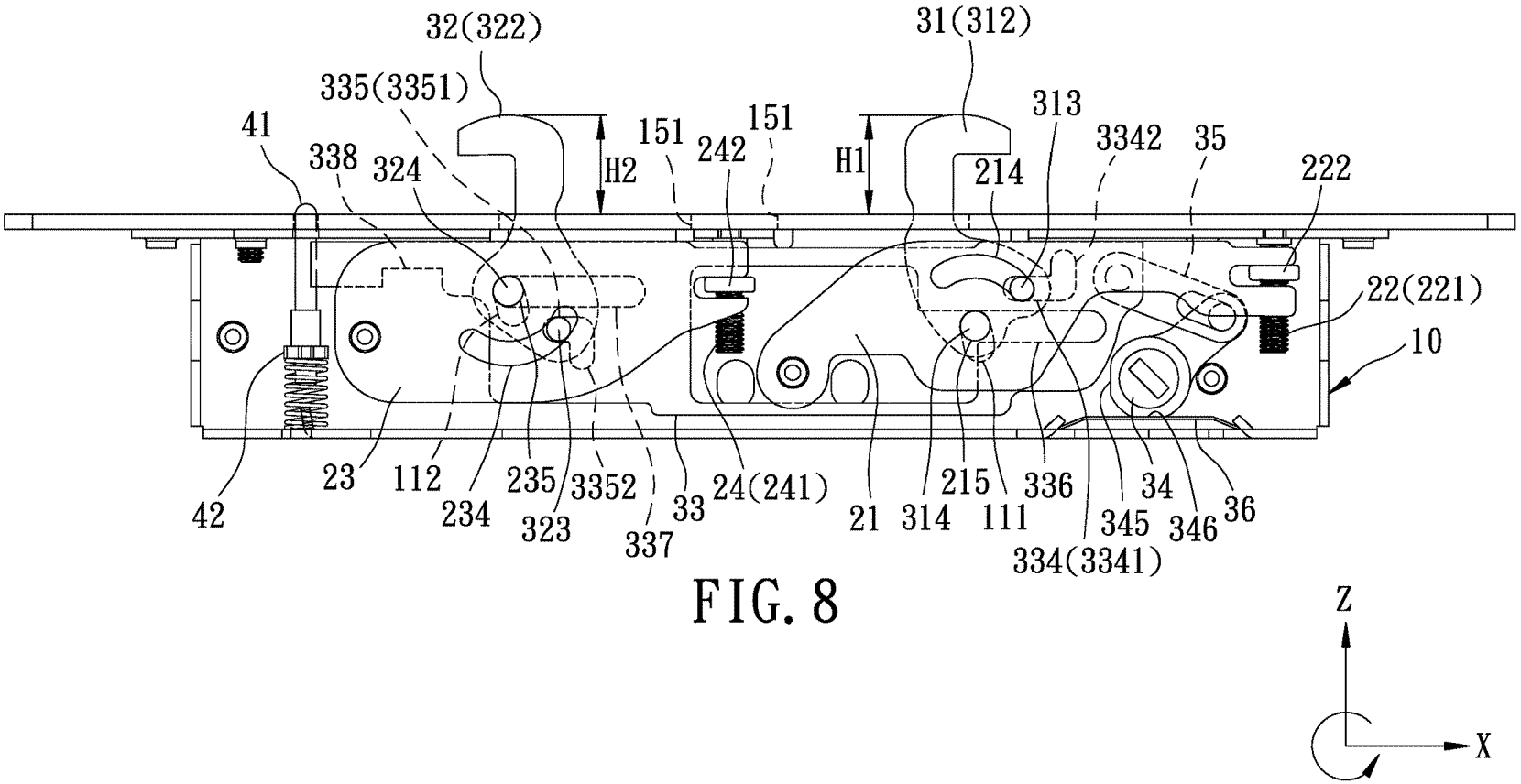
FIG. 8 is still another schematic side view illustrating the first and second hook members, each of which is at a locking position.
Figure 9:
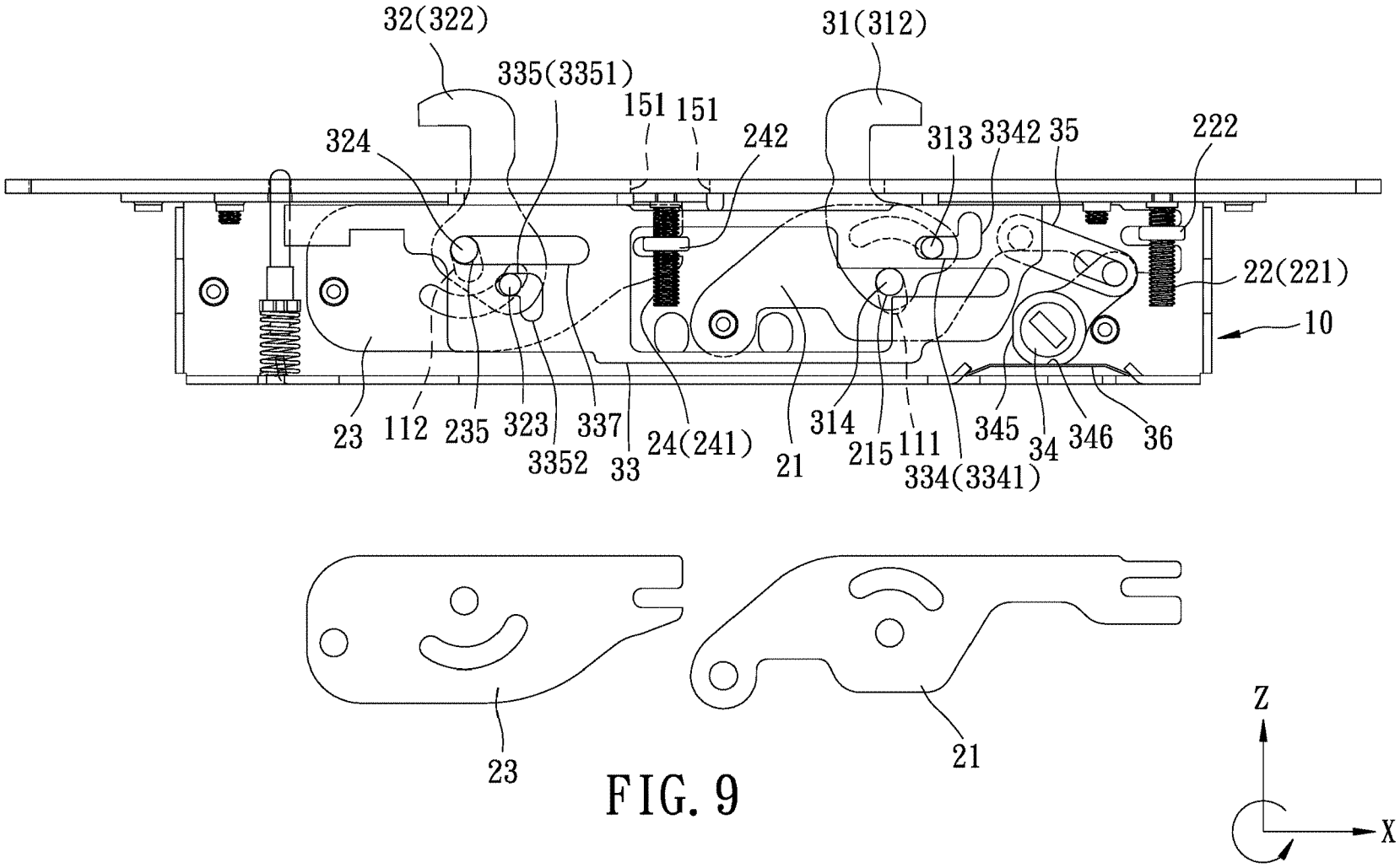
FIG. 9 is still another schematic side view illustrating the first and second hook members, each of which is at the locking position.

In this embodiment, the rotary operating member 34 is operable to move the actuating guide plate 33 in the first direction (X) via the link member 35, so as to move each of the first and second hook members 31, 32 relative to the casing unit 10 between an unlocking position (see FIGS. 6 and 7) and a locking position (see FIGS. 8 and 9).

Referring to FIGS. 6 and 7, when each of the first and second hook members 31, 32 is at the unlocking position, the first and second hook members 31, 32 are located wholly within the casing unit 10, the first driven pin portion 313 of the first hook member 31 engages the second groove portion 3342 of the first driving groove 334, the second driven pin portion 323 of the second hook member 32 engages the second groove portion 3352 of the second driving groove 335, the first positioning surface 345 is in abutment with the positioning resilient plate 36 so as to position the rotary operating member 34 relative to the casing unit 10, and the second positioning surface 346 is spaced apart from the positioning resilient plate 36.

Referring to FIGS. 8 and 9, when the each of first and second hook members 31, 32 is at the locking position, the hook portions 312, 322 of the first and second hook members 31, 32 extend out of the casing unit 10 through the through grooves 151, respectively, the first driven pin portion 313 of the first hook member 31 engages the first groove portion 3341 of the first driving groove 334, the second driven pin portion 323 of the second hook member 32 engages the first groove portion 3351 of the second driving groove 335, the first positioning surface 345 is spaced apart from the positioning resilient plate 36, and the second positioning surface 346 is in abutment with the positioning resilient plate 36 so as to position the rotary operating member 34 relative to the casing unit 10. At this time, the first driven pin portion 313 of the first hook member 31 is prevented from moving into the second groove portion 3342 of the first driving groove 334, and the second driven pin portion 323 of the second hook member 32 is prevented from moving into the second groove portion 3352 of the second driving groove 335, unless the actuating guide plate 33 is moved. More specifically, the first driven pin portion 313 of the first hook member 31 is positioned within the first groove portion 3341 of the first driving groove 334 so that the first hook member 31 is prevented from rotating about the center of the first pivoted pin portion 314 thereof, and the second driven pin portion 323 of the second hook member 32 is positioned within the first groove portion 3351 of the second driving groove 335 so that the second hook member 32 is prevented from rotating about the center of the second pivoted pin portion 324 thereof. As a result, the two-point lock of this disclosure is prevented from being picked by directly applying force on the hook portions 312, 322 of the first and second hook members 31, 32 when each of the first and second hook members 31, 32 is at the locking position.

As shown in FIGS. 6 and 8, when each of the first and second hook members 31, 32 moves between the unlocking position and locking position, the first driven pin portion 313 of the first hook member 31 moves along the first arc-shaped grooves 214 of the first adjusting guide plates 21, and the second driven pin portion 323 of the second hook member 32 moves along the second arc-shaped grooves 234 of the second adjusting guide plates 23. The first arc-shaped grooves 214 of the first adjusting guide plates 21, and the second arc-shaped grooves 234 of the second adjusting guide plates 23 are configured to limit the range of rotation of each of the first and second hook members 31, 32.

In addition, as shown in FIGS. 8 and 9, the first adjusting guide plates 21 and the first adjusting assembly 22 are operable to adjust an extent (H1) by which the hook portion 312 of the first hook member 31 extends out of the casing unit 10 when the first hook member 31 is at the locking position, and the second adjusting guide plates 23 and the second adjusting assembly 24 are operable to adjust an extent (H2) by which the hook portion 322 of the second hook member 32 extends out of the casing unit 10 when the second hook member 32 is at the locking position.

When the first adjusting bolt 221 is rotated, the first nut member 222 is driven to move in the second direction (Z) to rotate the first adjusting guide plates 21 relative to the casing unit 10, so as to move the first hook member 31 substantially in the second direction (Z). The first height limiting grooves 111 of the side walls 11 of the casing unit 10 are configured to limit the range of the movement of the first hook member 31 in the second direction (Z). Since the first driven pin portion 313 of the first hook member 31 engages the first driving groove 334 and the first pivoted pin portion 314 of the first hook member 31 engages the first guiding groove 336 of the actuating guide plate 33, the movement of the first hook member 31 results in movement of the actuating guide plate 33 within the casing unit 10.

Similarly, when the second adjusting bolt 241 is rotated, the second nut member 242 is driven to move in the second direction (Z) to rotate the second adjusting guide plates 23 relative to the casing unit 10, so as to move the second hook member 32 substantially in the second direction (Z). The second height limiting grooves 112 of the side walls 11 of the casing unit 10 are configured to limit the range of the movement of the second hook member 32 in the second direction (Z). Since the second driven pin portion 323 of the second hook member 32 engages the second driving groove 335 and the second pivoted pin portion 324 of the second hook member 32 engages the second guiding groove 337 of the actuating guide plate 33, the movement of the second hook member 32 results in movement of the actuating guide plate 33 within the casing unit 10.

Referring to FIGS. 5 and 6, the safety unit 40 includes a safety rod member 41 that is mounted to the end wall 15 of the casing unit 10 and that is movable relative to the casing unit 10 in the second direction (Z), a safety block 42 that is connected to the safety rod member 41 and that is disposed in the casing unit 10, and a resilient member 43 that has two opposite ends respectively abut against the safety block 42 and the surrounding wall 14 of the casing unit 10. In this embodiment, the resilient member 43 is configured as a compression spring. The resilient member 43 resiliently biases the safety block 42 toward the extension portion 333 of the actuating guide plate 33. When each of the first and second hook members 31, 32 is at the unlocking position and when the safety rod member 41 is not pressed, the safety block 42 engages the safety limiting groove 338 of the actuating guide plate 33 (see FIG. 6). When each of the first and second hook members 31, 32 is at the locking position, the safety block 42 is separated from the safety limiting groove 338 of the actuating guide plate 33 (see FIG. 6). In use with a door plate (not shown), only when the door plate is closed (i.e., the safety rod member 41 is pressed) the actuating guide plate 33 can be driven by the rotary operating member 34 to move each of the first and second hook members 31, 32 between the unlocking position and the locking position. When the doorplate is opened (i.e., the safety rod member 41 is not pressed), the safety block 42 engages the safety limiting groove 338 of the actuating guide plate 33 so as to prevent the actuating guide plate 33 from being driven by the rotary operating member 34, thereby preventing each of the first and second hook members 31, 32 from moving away from the unlocking position to bump into a door frame (not shown).

Figure 10:
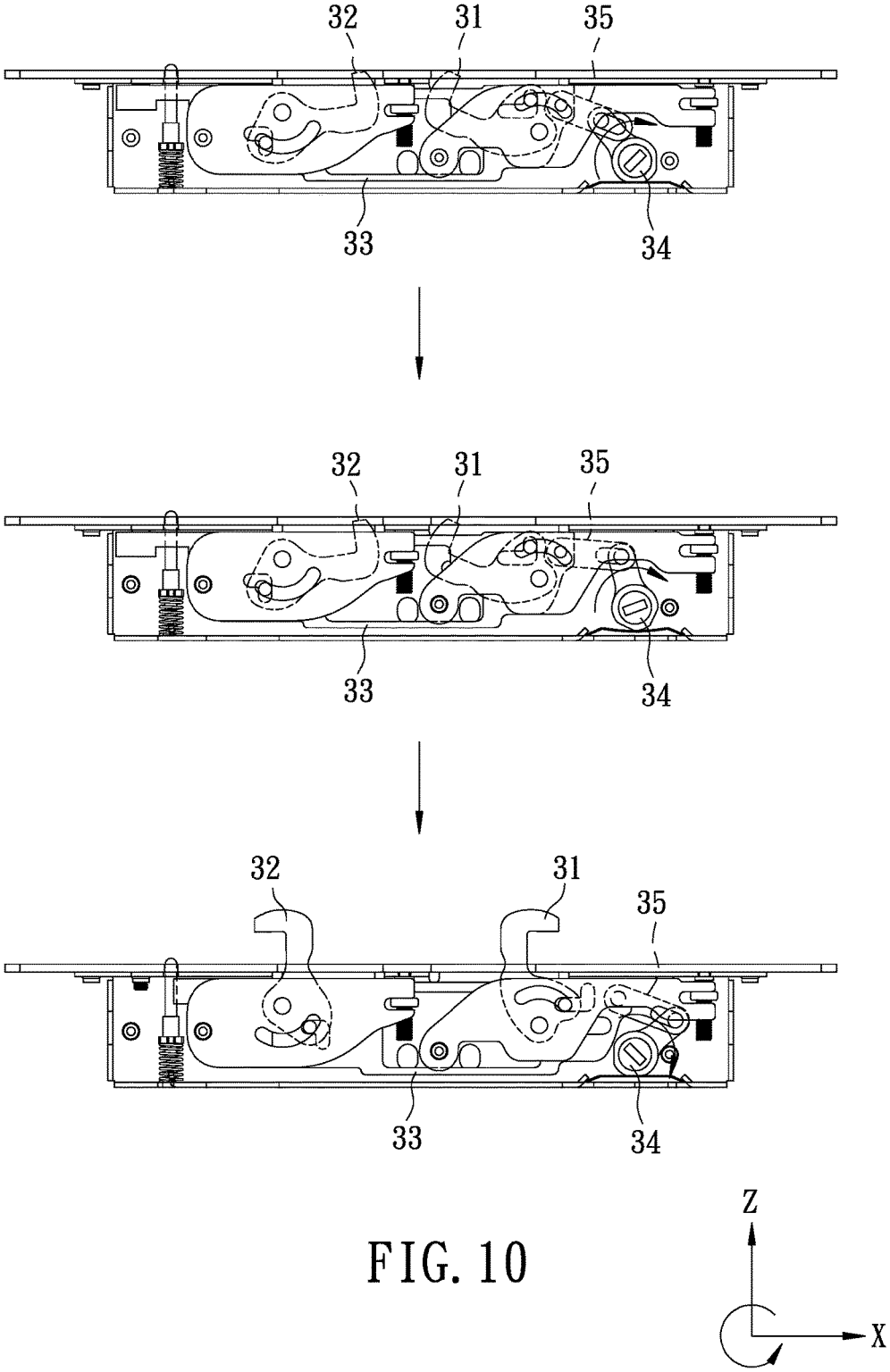
FIG. 10 is a schematic view illustrating operation of the embodiment for moving each of the first and second hook members to the locking position.
Figure 11:
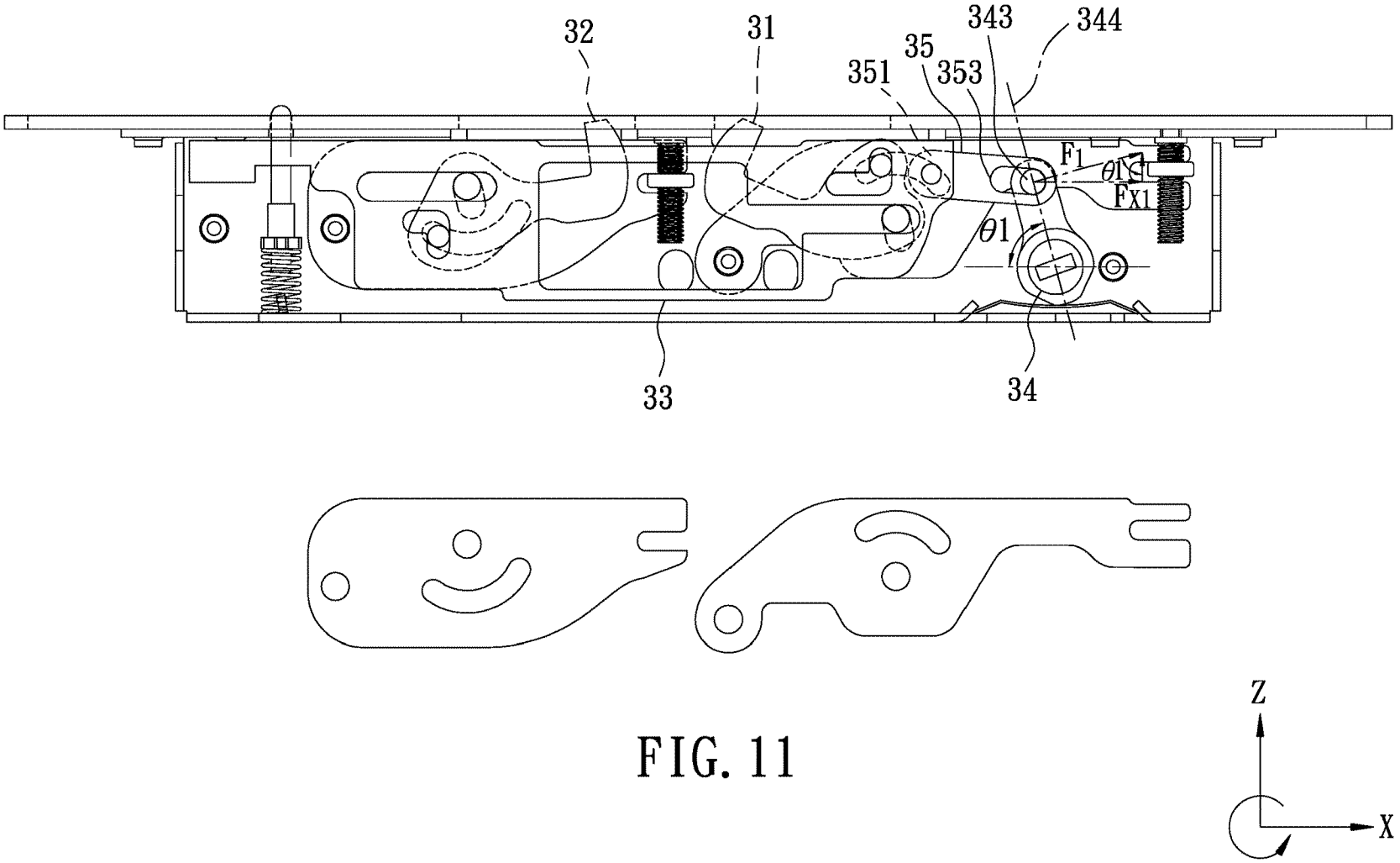
FIG. 11 is a schematic side view illustrating cooperation of a rotary operating member and a link member of the embodiment.

Referring to FIGS. 10 and 11, to move each of the first and second hook members 31, 32 from the unlocking position to the locking position, the rotary operating member 34 is first rotated clockwise such that the guiding pin portion 343 thereof moves along the elongated groove 353 of the link member 35 without driving movement of the actuating guide plate 33 until the guiding pin portion 343 moves to an end of the elongated groove 353 which is distal from the first end portion 351 of the link member 35. At this time, the imaginary reference line 344 of the rotary operating member 34 cooperates with a horizontal line to form a relatively large angle (θ1, about 76 degrees) therebetween. As such, to move the actuating guide plate 33 for moving the first and second hook members 31, 32, a user needs to further rotate the rotary operating member 34 clockwise to generate a resultant force (F1) slightly greater than a horizontal component (Fx1) thereof that is required for moving the actuating guide plate 33. In this case, F1=Fx1/sin θ1=Fx1/sin 76°=1.03Fx1. In other words, the user only needs to rotate the rotary operating member 34 to generate a force that is 1.03 times the required force to move the actuating guide plate 33. Such operation is relatively labor-saving.

Figure 12:
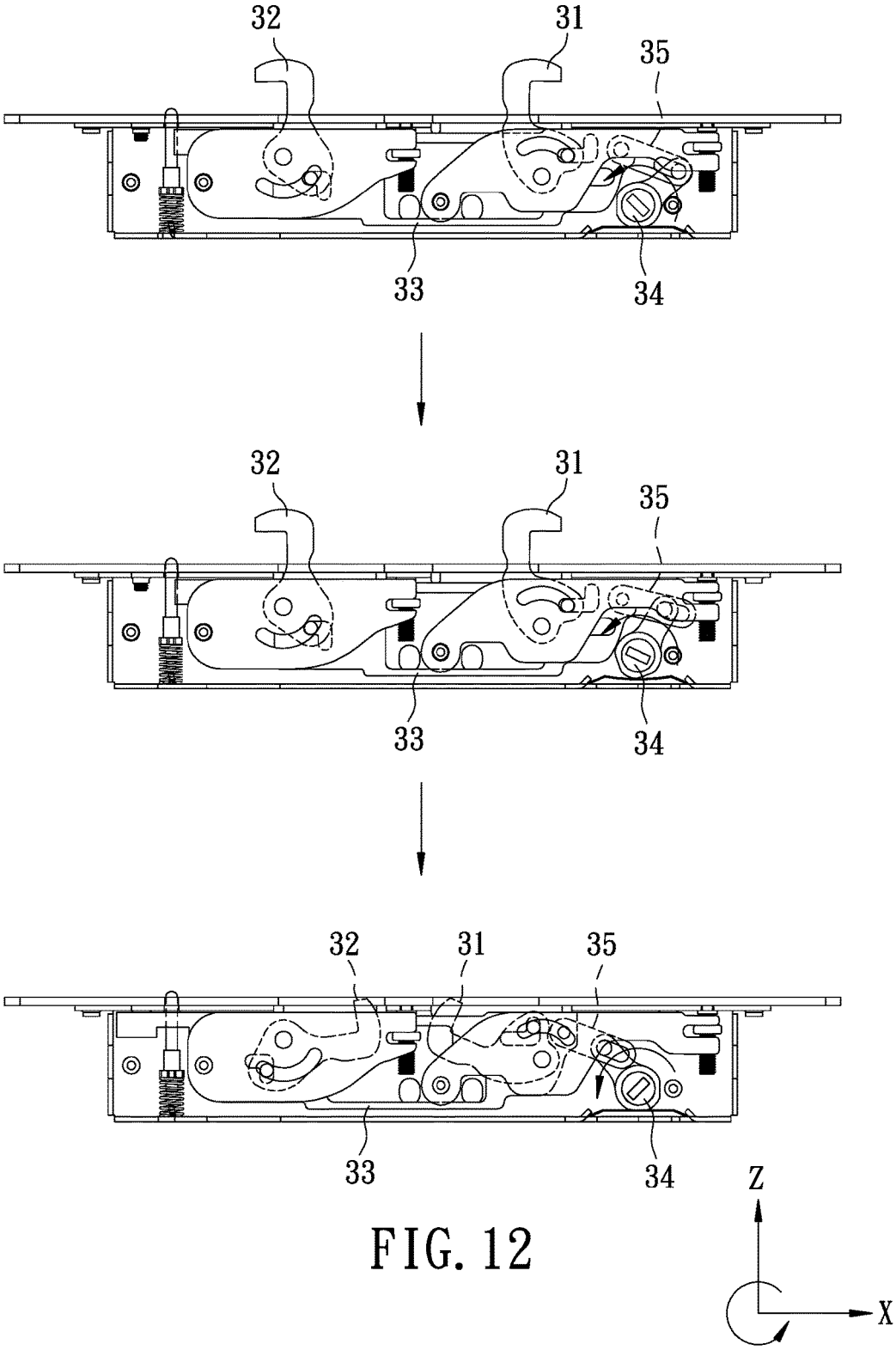
FIG. 12 is a schematic view illustrating operation of the embodiment for moving each of the first and second hook members to the unlocking position.
Figure 13:
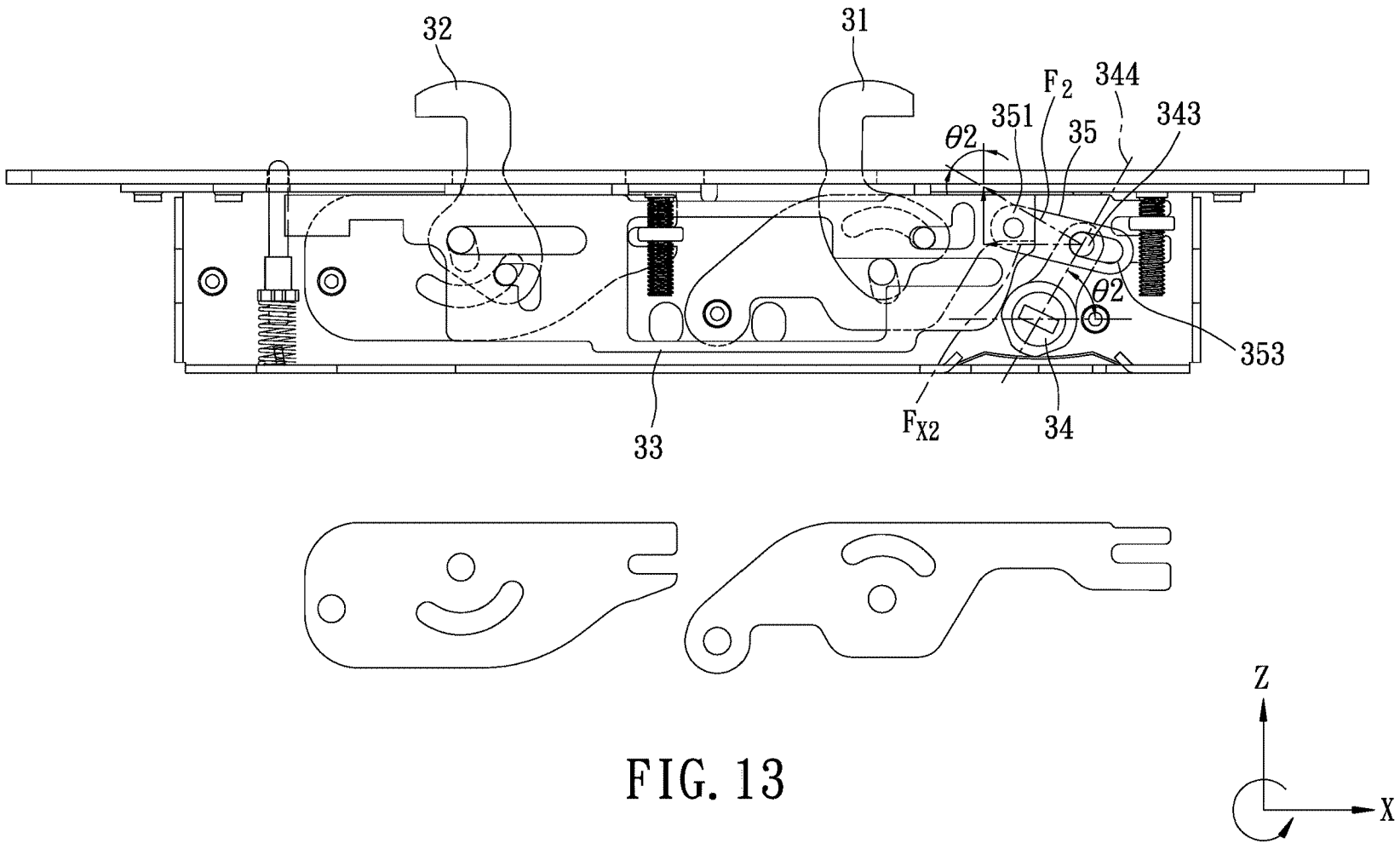
FIG. 13 is a schematic side view illustrating cooperation of the rotary operating member and the link member.

Referring to FIGS. 12 and 13, similarly, when each of the first and second hook members 31, 32 is moved from the locking position to the unlocking position, the rotary operating member 34 is first rotated counterclockwise such that the guiding pin portion 343 thereof moves along the elongated groove 353 of the link member 35 without driving movement of the actuating guide plate 33 until the guiding pin portion 343 moves to an opposite end of the elongated groove 353 which is proximal to the first end portion 351 of the link member 35. At this time, the imaginary reference line 344 of the rotary operating member 34 cooperates with the horizontal line to form a relatively large angle (θ2, about 59 degrees) therebetween. As such, to move the actuating guide plate 33 and the first and second hook members 31, 32, a user needs to further rotate the rotary operating member 34 counterclockwise to generate a resultant force (F2) slightly greater than a horizontal component (Fx2) thereof that is required for moving the actuating guide plate 33. In this case, F2=Fx2/sin θ2=Fx2/sin 59°=1.17Fx2. In other words, the user only needs to rotate the rotary operating member 34 to generate a force that is 1.17 times the required force to move the actuating guide plate 33. Such operation is also relatively labor-saving.

The advantages of this disclosure are as follows.

1. The first and second hook members 31, 32 are synchronously moved by a single element (i.e., the actuating guide plate 33), so that the mechanism for actuating the first and second hook members 31, 32 is simpler than that of U.S. Pat. No. 6,264,252.

2. By virtue of the first adjusting guide plates 21, the first adjusting assembly 22, the second adjusting guide plates 23 and the second adjusting assembly 24, the extent (H1) by which the hook portion 312 of the first hook member 31 extends out of the casing unit 10 and the extent (H2) by which the hook portion 322 of the second hook member 32 extends out of the casing unit 10 can be adjusted independently. Compared with the conventional two-point lock of U.S. Pat. No. 8,376,414, the two-point lock of this disclosure employs a single-casing structure (i.e., the casing unit 10) for adjusting the first and second hook members 31, 32, so that the weight thereof and the manufacturing cost thereof can be lowered.

3. Since the guiding pin portion 343 of the rotary operating member 34 movably engages the elongated groove 353 of the link member 35, a user only needs to rotate the rotary operating member 34 to generate a force that is slightly greater than the required force to move the actuating guide plate 33 for moving each of the first and second hook members 31, 32 between the unlocking position and the locking position. Such operation is relatively labor-saving.

4. The positioning resilient plate 36 deforms slightly during the rotation of the rotary operating member 34 for moving the first and second hook members 31, 32, so that the positioning resilient plate 36 only needs to occupy a relatively small space in the casing unit 10, and the service life thereof is prolonged.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A two-point lock comprising:

a casing unit extending along a first axis;

an adjusting unit including a pair of first adjusting guide plates that are pivoted to and disposed in said casing unit and that are spaced apart from each other, a first adjusting assembly that is disposed to said casing unit, a pair of second adjusting guide plates that are pivoted to and disposed in said casing unit and that are spaced apart from each other, and a second adjusting assembly that is disposed to said casing unit, each of said first adjusting guide plates having a first arc-shaped groove, said first adjusting assembly including a first adjusting bolt that is rotatably mounted to said casing unit, and a first nut member that is threadably engaged with said first adjusting bolt and that is coupled to said first adjusting guide plates, said first adjusting bolt being rotatable to move said first nut member so as to rotate said first adjusting guide plates relative to said casing unit, said second adjusting guide plates being spaced apart from said first adjusting guide plates along the first axis, each of said second adjusting guide plates having a second arc-shaped groove, said second adjusting assembly including a second adjusting bolt that is rotatably mounted to said casing unit, and a second nut member that is threadably engaged with said second adjusting bolt and that is coupled to said second adjusting guide plates, said second adjusting bolt being rotatable to move said second nut member so as to rotate said second adjusting guide plates relative to said casing unit; and a locking unit including a first hook member that is pivotable between said first adjusting guide plates, a second hook member that is pivotable between said second adjusting guide plates, an actuating guide plate that is disposed between said first adjusting guide plates and between said second adjusting guide plates and that is substantially movable along the first axis, a rotary operating member that is rotatably disposed on said casing unit, and a link member that is connected between said actuating guide plate and said rotary operating member, said first hook member having a first driven pin portion that movably engages said first arc-shaped grooves of said first adjusting guide plates, and a first pivoted pin portion that is pivoted to said first adjusting guide plates, said second hook member having a second driven pin portion that movably engages said second arc-shaped grooves of said second adjusting guide plates, and a second pivoted pin portion that is pivoted to said second adjusting guide plates, said actuating guide plate having a first driving groove that is movably engaged with said first driven pin portion of said first hook member, a second driving groove that is movably engaged with said second driven pin portion of said second hook member, a first guiding groove that extends along the first axis and that is movably engaged with said first pivoted pin portion of said first hook member, and a second guiding groove that extends along the first axis and that is movably engaged with said second pivoted pin portion of said second hook member, said rotary operating member being located outside a space between said first and second hook members, and being adjacent to an end of said casing unit along the first axis, said rotary operating member being operable to move said actuating guide plate along the first axis via said link member, so as to move each of said first and second hook members relative to said casing unit between an unlocking position and a locking position such that, when each of said first and second hook members is at the unlocking position, said first and second hook members are wholly located within said casing unit, when each of said first and second hook members is at the locking position, said first and second hook members partially extend out of said casing unit, and when said first and second hook members move between the unlocking position and the locking position, said first driven pin portion of said first hook member moves along said first arc-shaped grooves of said first adjusting guide plates, and said second driven pin portion of said second hook member moves along said second arc-shaped grooves of said second adjusting guide plates, said first adjusting guide plates and said first adjusting assembly being operable to adjust an extent by which said first hook member extends out of said casing unit when said first hook member is at the locking position, said second adjusting guide plates and said second adjusting assembly being operable to adjust an extent by which said second hook member extends out of said casing unit when said second hook member is at the locking position.

2. The two-point lock as claimed in claim 1, wherein said link member has a first end portion that is pivotally connected to said actuating guide plate, a second end portion that is opposite to said first end portion, and an elongated groove that is proximate to said second end portion, said rotary operating member having a guiding pin portion that movably engages said elongated groove of said link member such that, during operation for moving said first and second hook members from one of the unlocking position and the locking position to the other one of the unlocking position and the locking position, said rotary operating member is first rotated to move said guiding pin portion along said elongated groove of said link member to one of two opposite ends of said elongated groove without driving movement of said actuating guide plate, and then is further rotated to move said actuating guide plate via said link member.

3. The two-point lock as claimed in claim 2, wherein said link member further has an imaginary reference line, said elongated groove extending along the imaginary reference line.

4. The two-point lock as claimed in claim 2, wherein said locking unit further includes a positioning resilient plate that is disposed between said rotary operating member and said casing unit, said rotary operating member having an input end portion that is pivoted to said casing unit, and an output end portion that is opposite to said input end portion, said guiding pin portion being disposed at said output end portion, said input end portion being formed with first and second positioning surfaces such that, when each of said first and second hook members is at the unlocking position, one of said first and second positioning surfaces is in abutment with said positioning resilient plate so as to position said rotary operating member relative to said casing unit, and the other one of said first and second positioning surfaces being spaced apart from said positioning resilient plate, and when each of said first and second hook members is at the locking position, the other one of said first and second positioning surfaces being in abutment with said positioning resilient plate so as to position said rotary operating member relative to said casing unit, and the one of said first and second positioning surfaces being spaced apart from said positioning resilient plate.

5. The two-point lock as claimed in claim 4, wherein said rotary operating member has an imaginary reference line extending along said output end portion such that, when said rotary operating member is rotated to move said guiding pin portion along said elongated groove of said link member to one of the opposite ends of said elongated groove without driving movement of said actuating guide plate, the imaginary reference line of said rotary operating member cooperates with a line extending along the first axis to form an acute angle therebetween that is greater than 45 degrees.

6. The two-point lock as claimed in claim 4, wherein said casing unit includes two side walls that are spaced apart from each other, each of said side walls having a first height limiting groove, and a second height limiting groove that is spaced apart from said first height limiting groove, each of said first adjusting guide plates further having a first pivoted end portion that is pivoted to said casing unit, a first adjusting end portion that is coupled to said first nut member of said first adjusting assembly, a first intermediate portion that is connected between said first pivoted end portion and said first adjusting end portion, and a first pivot hole that is formed in said first intermediate portion, said first arc-shaped groove being formed in said first intermediate portion, said first pivot hole being located at a center of curvature of said first arc-shaped groove, each of said second adjusting guide plates further having a second pivoted end portion that is pivoted to said casing unit, a second adjusting end portion that is coupled to said second nut member of said second adjusting assembly, a second intermediate portion that is connected between said second pivoted end portion and said second adjusting end portion, and a second pivot hole that is formed in said second intermediate portion, said second arc-shaped groove being formed in said second intermediate portion, said second pivot hole being located at a center of curvature of said second arc-shaped groove, said first pivoted pin portion of said first hook member rotatably engaging said first pivot holes of said first adjusting guide plates, and movably engaging said first height limiting grooves of said side walls of said casing unit, said second pivoted pin portion of said second hook member rotatably engaging said second pivot holes of said second adjusting guide plates, and movably engaging said second height limiting grooves of said side walls of said casing unit.

7. The two-point lock as claimed in claim 6, wherein said casing unit further includes a first axle portion that is disposed between said side walls, and a second axle portion that is disposed between said side walls and that is spaced apart from said first axle portion, each of said first adjusting guide plates further having a first axle hole that is formed in said first pivoted end portion and that permits said first axle portion of said casing unit to rotatably extend therethrough, and a first engaging groove that is formed in said first adjusting end portion, said first adjusting guide plates being pivotable about said first axle portion of said casing unit, said first nut member of said first adjusting assembly movably engaging said first engaging groove of each of said first adjusting guide plates, each of said second adjusting guide plates further having a second axle hole that is formed in said second pivoted end portion and that permits said second axle portion of said casing unit to rotatably extend therethrough, and a second engaging groove that is formed in said second adjusting end portion, said second adjusting guide plates being pivotable about said second axle portion of said casing unit, said second nut member of said second adjusting assembly movably engaging said second engaging groove of each of said second adjusting guide plates.

8. The two-point lock as claimed in claim 6, wherein said first driving groove has a first groove portion that substantially extends along the first axis, and a second groove portion that is substantially perpendicular to said first groove portion, said second driving groove having a first groove portion that substantially extends along the first axis, and a second groove portion that is substantially perpendicular to said first groove portion such that, when each of said first and second hook members is at the unlocking position, said first driven pin portion of said first hook member engages said second groove portion of said first driving groove, and said second driven pin portion of said second hook member engages said second groove portion of said second driving groove, and when each of said first and second hook members is at the locking position, said first driven pin portion of said first hook member engages said first groove portion of said first driving groove, and said second driven pin portion of said second hook member engages said first groove portion of said second driving groove.

9. The two-point lock as claimed in claim 8, wherein said actuating guide plate further has a first plate portion that corresponds in position to said first hook member, a second plate portion that corresponds in position to said second hook member, an intermediate portion that is connected between said first and second plate portions, and a through groove that is formed in said intermediate portion and that permits said second nut member to extend therethrough, said first driving groove being formed in said first plate portion, said second driving groove being formed in said second plate portion, said first guiding groove being formed in said first plate portion, said second guiding groove being formed in said second plate portion, said first end portion of said link member being pivotally connected to said first plate portion of said actuating guide plate.

10. The two-point lock as claimed in claim 9, further comprising a safety unit, said actuating guide plate further having an extension portion that extends from said second plate portion away from said first plate portion along the first axis, and a safety limiting groove that is formed in said extension portion, said safety unit including a safety rod member that is mounted to said casing unit and that is movable relative to said casing unit along a second axis perpendicular to the first axis, a safety block that is connected to said safety rod member and that is disposed in said casing unit, and a resilient member that has two opposite ends respectively abut against said safety block and said casing unit, said resilient member resiliently biasing said safety block toward said extension portion of said actuating guide plate such that, when each of said first and second hook members is at the unlocking position and when said safety rod member is not pressed, said safety block engages said safety limiting groove of said actuating guide plate so as to prevent movement of said actuating guide plate in said casing unit, and when each of said first and second hook members is at the locking position, said safety block is separated from said safety limiting groove of said actuating guide plate so as to allow movement of said actuating guide plate in said casing unit.

* * * * *